US006054690A

United States Patent [19]

Petit et al.

[11] Patent Number: 6,054,690

[45] Date of Patent: Apr. 25, 2000

[54] HEATING ELEMENT, MANUFACTURING PROCESS AND APPLICATION

[75] Inventors: Dominique Petit, Housse, Belgium; Peter Wolki, Moenchengladbach, Germany

[73] Assignee: Norton Pampus GmbH, Willich, Germany

[21] Appl. No.: 08/945,556

[22] PCT Filed: Apr. 30, 1996

[86] PCT No.: PCT/IB96/00390

§ 371 Date: Feb. 19, 1998

§ 102(e) Date: Feb. 19, 1998

[87] PCT Pub. No.: WO96/35317

PCT Pub. Date: Nov. 7, 1996

[30] Foreign Application Priority Data

May 4, 1995 [FR] France ..... 95 05329

[51] Int. Cl.[7] ..... H05B 3/34

[52] U.S. Cl. ..... 219/528; 219/542

[58] Field of Search ..... 219/200–203, 219/209–213, 217, 218, 219, 528, 529, 538, 542, 543, 544, 545, 548, 549

[56] References Cited

U.S. PATENT DOCUMENTS

| | | | |
|---|---|---|---|
| 2,241,312 | 5/1941 | Luty | 219/211 |
| 3,757,087 | 9/1973 | Bernard | 219/549 |
| 4,251,712 | 2/1981 | Parr | 219/203 |
| 4,656,339 | 4/1987 | Grise | 219/528 |
| 4,661,689 | 4/1987 | Harrison | 219/528 |
| 4,725,717 | 2/1988 | Harrison | 219/528 |

FOREIGN PATENT DOCUMENTS

| | | |
|---|---|---|
| 1 335 428 | 7/1963 | France . |
| 1 085 784 | 10/1967 | United Kingdom . |
| 2052224 | 1/1981 | United Kingdom . |
| 2228165 | 8/1990 | United Kingdom . |

*Primary Examiner*—Tu Ba Hoang
*Attorney, Agent, or Firm*—Oblon, Spivak, McClelland, Maier & Neustadt, P.C.

[57] ABSTRACT

A heating element includes at least one substrate, at least one electrical resistance layer, and a binder configured to bind the electrical resistance layer to the substrate, wherein the binder has a melting temperature greater than an operating temperature of the heating element and includes a perfluorinated polymer.

21 Claims, 3 Drawing Sheets

HEATING ELEMENT, MANUFACTURING PROCESS AND APPLICATION

CROSS-REFERENCE TO RELATED APPLICATIONS

This application is a national stage application based on International Application PCT/IB96/00390 filed Apr. 30, 1996 and claiming priority to French Application 95/05329 filed May 4, 1995.

BACKGROUND OF THE INVENTION

1. Field of the Invention

The present invention relates to a novel electrical heating element in the form of a film or thin sheet with laminated structure, comprising at least one electrically conductive layer and at least one substrate.

2. Discussion of the Background

Electrical heating elements used in household applications, for example, irons, grills, etc. are formed by resistance wires embedded in an insulating ceramic material, itself placed in a metal casing. One drawback of this type of electrical heating element is its thermal inertia. Another drawback is that it is ill-suited to complex contours.

Furthermore, it is thick and the implements which use it are large.

Electrical heating elements are also known which are in the form of sheets having multiple layers; an electrically conductive layer formed by a thin metal film, bonded onto a substrate by means of a hot-melt adhesive layer which is intended to withstand heat. Suitable hot-melt layers are extruded films having a thickness of generally more than 20 $\mu$m.

One drawback of this heating element is the low conductivity of the hot-melt film. Furthermore, this low conductivity cannot be improved substantially by incorporating thermally conductive fillers in the extruded layer.

SUMMARY OF THE INVENTION

The invention overcomes the drawbacks which have been mentioned.

It proposes a heating element which is in the form of a thin film and has low thermal inertia, and whose manufacture is simplified.

The heating element according to the invention comprises at least one substrate and at least one electrical resistance layer which adheres to the substrate via a binder formed from a dispersion, solution or powder deposited directly on the substrate.

The binder according to the invention may be selected from dispersions, solutions or powders of at least one polymer (or copolymer) whose melting temperature is greater than the operating temperature of the heating element and which can be deposited on a substrate, if appropriate with a small thickness. The polymer is preferably selected from perfluorinated polymers, in particular perfluoroalkoxyalkane (PFA), MFA and polytetrafluoroethylene (PTFE).

According to one aspect of the invention, a dispersion or solution of at least one of the polymers mentioned above is chosen, it being possible for this dispersion or solution to be, if appropriate, heavily loaded with thermally conductive and electrically insulating fillers, for example, aluminium oxide $Al_2O_3$, silicon carbide SiC, mica and glass powder.

The substrate according to the invention which, in particular, fulfils the function of mechanically supporting the heating element, as well as the function of an electrical insulator, may be any kind of sheet, selected according to the application envisaged for the heating element. This sheet may be based on a thermoplastic or thermosetting material or a cellulosic material, or an optionally impregnated glass fabric or web, a fabric or web based on ceramic fibers, or alternatively a sheet that is extruded or rolled out. The thermoplastic or thermosetting material is, in particular, selected from polytetrafluoroethylene (PTFE), perfluoroalkoxyalkane (PEA), MFA, perfluoro-(ethylene-propylene) (FEP), ethylene-tetrafluoroethylene (PTFE), polyvinylidene fluoride (PVDF), polyethyleneterephthalate (PET) and polyimide (KAPTON).

The substrate generally has a thickness of between 20 $\mu$m and 500 $\mu$m or more, if appropriate, depending on the application.

According to one embodiment of the invention, the electrical resistance layer is a film or a thin sheet of an electrically conductive material, in particular one based on a metal such as copper, nickel, aluminium or a metal alloy such as bronze, brass or Constantan®.

With a view, in particular, to improving the adhesion of the metallic conductive thin film, it may, on at least one of its two faces, have a structured surface obtained, for example, by rolling in a calender filled with rollers having structured surfaces, or a rough surface obtained, for example, by sandblasting or an abrasive treatment.

The conductive metal sheet may, as a variant, be replaced by an electrically conductive fabric or by a layer formed by a mat of electrically conductive fibers.

The thickness of the conductive thin film may be calculated on the basis of the conductor and the application envisaged for the heating element, that is to say according to the desired electrical power.

Depending on the application, the conductive film may have the shape of a coil circuit. A shape of this type is obtained, for example, from a continuous film which is locally treated by chemical etching, in particular using a mixture of hydrochloric acid and hydrogen peroxide.

According to one variant of the invention, the electrical resistance is obtained directly with the desired shape by depositing an electrically conductive composition on the substrate, for example by screen printing, by electrostatic spraying with the use of a stencil, etc.

According to another variant of the invention, the electrical resistance layer merges with the binder layer which, for this purpose, is heavily loaded with particles in the form of powder or fibers of electrically conductive material, for example metal particles or particles coated with metal, or graphite particles.

The heating element according to the invention generally furthermore comprises an electrically insulating covering over the electrical resistance layer. This covering is, for example, a second substrate, of the same type as the first substrate described above, which can adhere to the electrical resistance layer via another adhesive layer.

Constructing the heating element from thin films makes it thin, leading to very small thermal inertia.

The invention also relates to a process for manufacturing the heating element. In this process, the substrate, the binder and the electrically conductive layer which are used are selected from the products described above.

The process uses the following steps:

the substrate to be used as a support, at least temporarily, for producing the heating element is prepared, the binder is deposited on the substrate from a dispersion, solution or a powder of this binder, after optional drying, the conductive layer, which is, in particular, in the form of a metallic film, is assembled with the binder-coated substrate by pressure, for example by pressing between the plates of a press or by calendering between rollers, the conductive layer is chemically treated, in particular by chemical etching, in order to give this layer the desired shape for the electrical resistor, a prelaminated element is obtained, a second substrate, coated with a layer of binder, is assembled with the prelaminated element by pressure, while placing the layer of binder of the second substrate in contact with the conductive layer, the thin heating element with laminated structure and low thermal inertia is finally obtained.

The use of a solution or dispersion of binder makes it possible to obtain thin films and, not withstanding, very good adhesion between the elements of the laminate, which is stable over time and under the most extreme of working conditions.

When, as the heating electrical resistance layer, the heating element uses a resistor obtained through directly depositing a conductive composition by screen printing or spraying using a stencil, the manufacturing process uses the following operations;

the electrically conductive composition is deposited on the prepared substrate using a printing screen or a stencil, the deposited layer is dried, a second substrate, coated with a layer of binder, is assembled with the substrate coated with the heating resistor by pressure. The electrical resistor is finally coated in the binder layer of the second substrate.

When, as the heating electrical resistance layer, the heating element uses a layer obtained from conductive particles dispersed in the binder, the manufacturing process may then use the following operations:

a dispersion of the binder and the electrically conductive particles is deposited on the prepared substrate, after optionally drying the deposited layer, this layer containing the metal particles is chemically treated so as to give it the desired shape for the electrical resistor, a second substrate, coated with a layer of binder, is assembled with the previously prepared substrate covered with the electrical resistor by pressure.

BRIEF DESCRIPTION OF THE DRAWINGS

Other characteristics and advantages of the invention will emerge from the following examples which are described with reference to the figures.

DISCUSSION OF THE PREFERRED EMBODIMENTS

Figure 1:
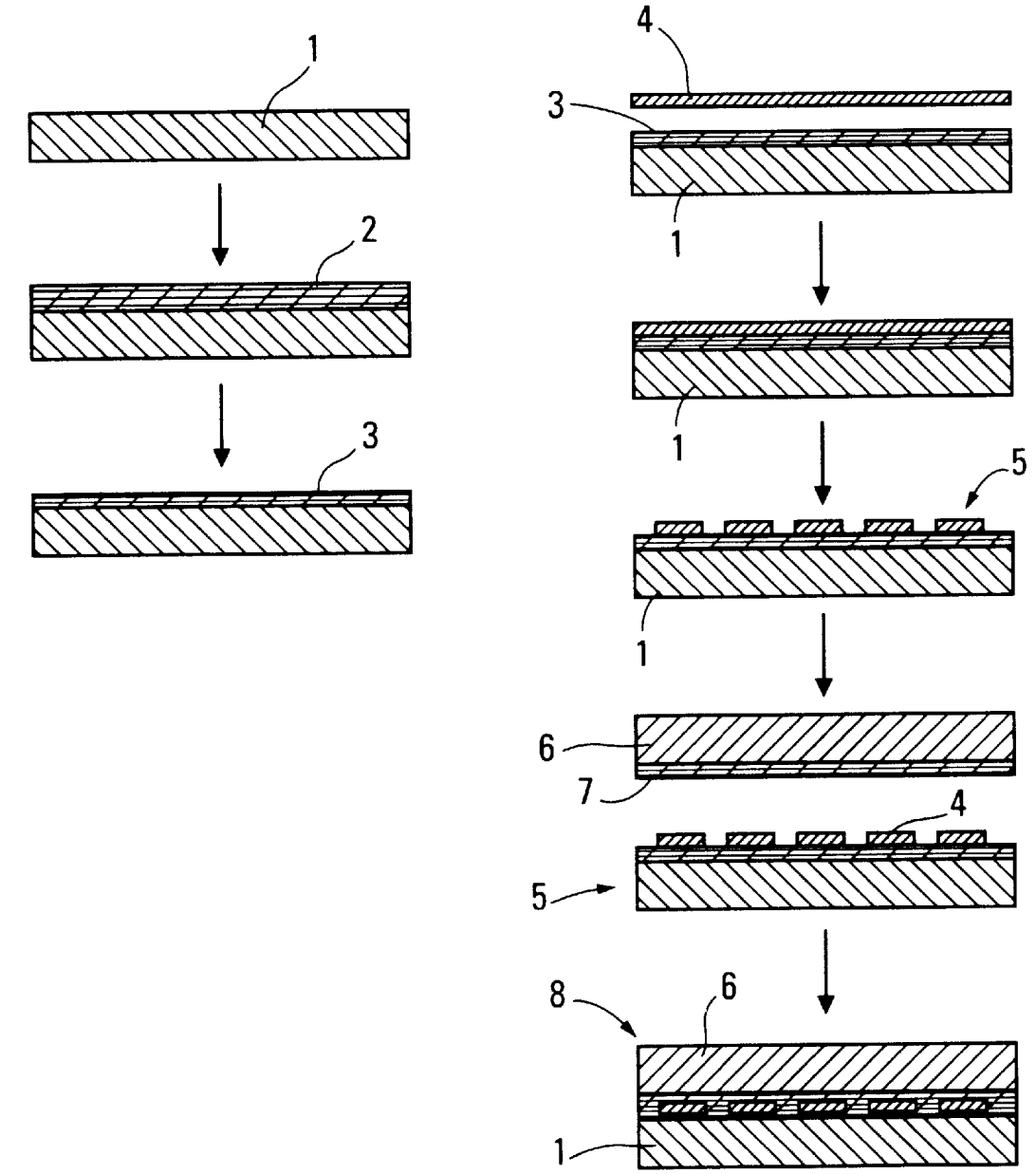
FIG. 1 represents the various stages in the manufacture of an example of a heating element according to the invention, using a metal film as heating electrical resistor.

FIG. 1, the substrate 1 used as a support is a sheet formed from an 80 μm thick PTFE-impregnated glass fabric. A layer 2 of PFA in dispersion in water is deposited on this substrate by the technique of coating using a scraper or a pencil.

After drying at a temperature of 350° C., an approximately 10 μm thick layer is obtained.

A 50 μm thick Constantan® metal sheet 4 is deposited on this layer 3, and these elements are assembled by pressing between the plates of a press, under a pressure of 40 bar at 350° C. for a few minutes.

After having protected the parts of the metal sheet which are intended to form the electrical resistor using a varnish deposited by screen printing, the assembly is treated with a mixture of hydrochloric acid and hydrogen peroxide in order to obtain the desired shape for the heating resistor through chemical etching. A prelaminated element 5 is obtained. A second substrate 6, coated with a layer of binder 7 and obtained, as in the case of the previous coated substrate, is assembled with the prelaminated element 5 by pressure under the same conditions as before.

A thin heating element 8 is finally obtained, which can be cut to the desired dimensions and can be used in various applications. As a variant, cutting may be carried out on the prefabricated element, in which case it is the cut prefabricated elements which will be covered with the second substrate.

Figure 2:
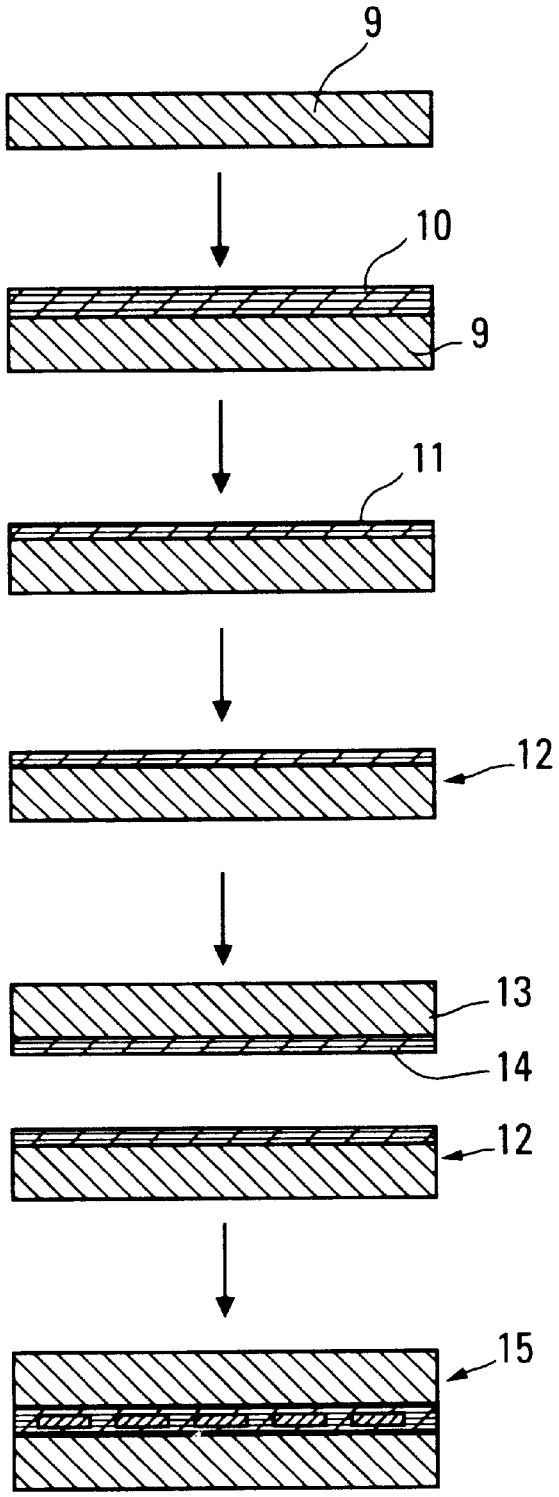
FIG. 2 represents the various stages in the manufacture of an example of a heating element according to the invention, using a layer based on metal particles as heating electrical resistor.

In FIG. 2, the substrate 9 used as a support may be the same as the one described with reference to FIG. 1.

A dispersion 10 containing PFA and electrically conductive metal particles is deposited on this PTFE-based substrate by coating.

The proportion of metal particles is determined in such a way as to have continuous electrical contact in the cover layer 11 formed on the substrate after drying. This proportion depends, in particular, on the dimensions and shape of the metal particles.

The conductive cover layer 11 is then chemically etched and a prelaminated element 12 is obtained.

This prelaminated element 12 is then assembled with a second substrate 13 coated, in this example, with the layer 14 of PFA-based binder.

A thin heating element 15 is obtained which can be cut to the desired dimensions. As a variant, cutting is carried out on the prefabricated (prelaminated) elements.

The heating element according to the invention can be used both in household applications and in industrial applications which require the use of thin heating elements having low thermal inertia. A plurality of heating elements may be used in combination.

The heating element may also advantageously be used in corrosive media such as treatment baths.

The flexibility of the heating element can vary, depending on the conductive layers and the applications envisaged.

The heating element may be used in a plane or thermoformed shape, in particular when it needs to be stiffened. By virtue of the fact that it is thin, it may also be used in the form of a tape which, for example, is wound around tubes. It may also optionally be provided with an adhesive layer so as to bond it to the object which is to be heated.

Figure 3:
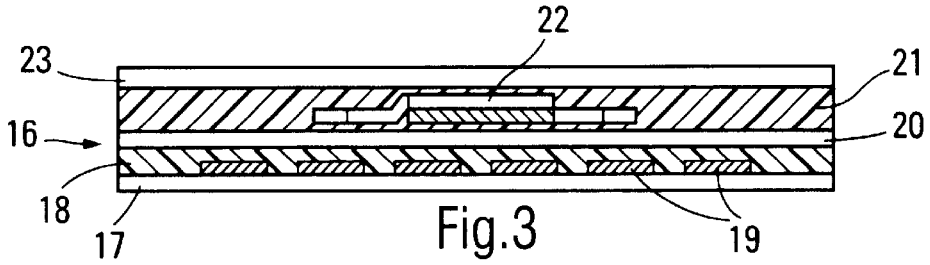
FIGS. 3 and 4 represent a heating element according to the invention, fitted with a thermostat.
Figure 4:
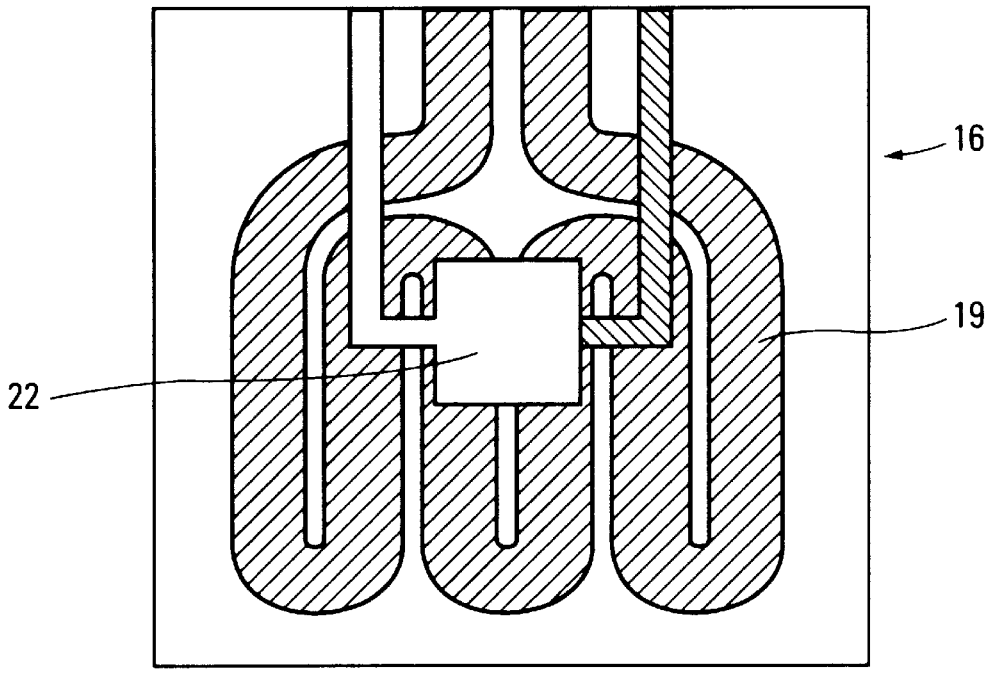

The heating element according to the invention may also be provided with a thermostat in the form of a flat thermocouple placed in an adhesive layer adjacent to a substrate. An embodiment of a heating element of this type is schematically represented in FIGS. 3 and 4. This heating element 16 comprises a first substrate 17, an adhesive layer 18 containing the heating resistor 19, a second substrate 20, a second adhesive layer 21 containing a thermocouple 22, and a third substrate 23. The proximity of the thermocouple 22 to the heating resistor permits very fast temperature control.

Figure 5:
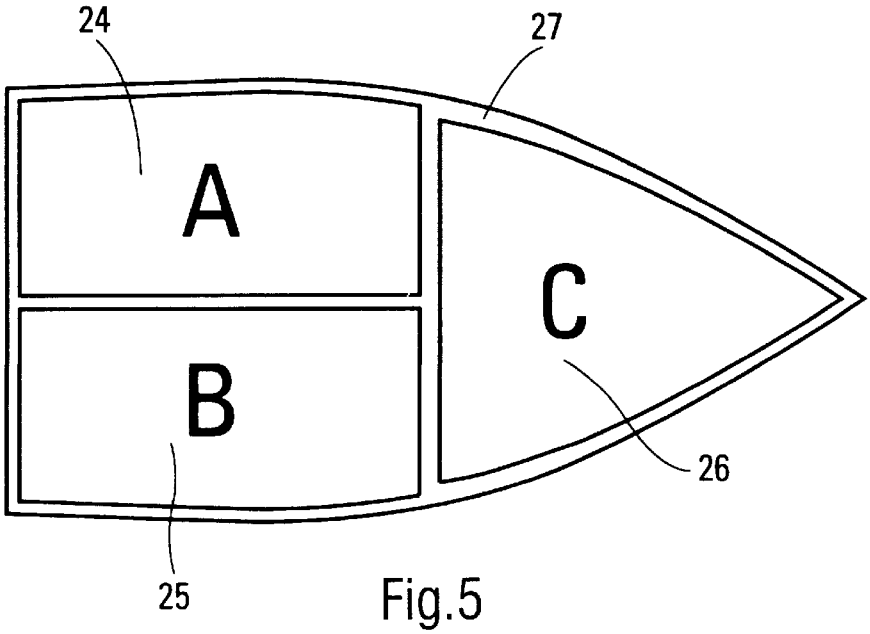
FIG. 5 represents an application for heating elements according to the invention.

FIG. 5 represents an application which utilizes a plurality of heating elements according to the invention. Thus, three heating elements 24, 25, 26 are arranged in the hot plate 27 of an iron. These three heating elements may have the same electrical resistivity or, as a variant, different resistivities which are constant or vary as a function of temperature. Each heating element corresponds to a heating zone which, if appropriate, may be controlled separately by a thermostat or, as a variant, by the resistant layer itself. This combination arrangement permits very good control of the temperature of the hot plate, irrespective of the ironing method which will actually be used.

We claim:

1. A heating element, comprising:

at least one substrate;

at least one electrical resistance layer; and a binder configured to bind said at least one electrical resistance layer to said at least one substrate, wherein said binder has a melting temperature greater than an operating temperature of the heating element and comprises a perfluorinated polymer.

2. The heating element according to claim 1, wherein the perfluorinated polymer is selected from PFA, MFA and PTFE.

3. The heating element according to claim 1, wherein the at least one substrate is impregnated with said perfluorinated polymer.

4. The heating element according to claim 3, wherein the perfluorinated polymer is PTFE.

5. The heating element according to claim 1, wherein the at least one electrical resistance layer comprises a metal sheet.

6. The heating element according to claim 1, wherein the at least one electrical resistance layer comprises electrically conductive particles dispersed in said binder.

7. The heating element according to claim 1, wherein the at least one electrical resistance layer is a product of depositing an electrically conductive composition.

8. The heating element according to claim 1, further comprising a thermostat coupled to said at least one electrical resistance layer.

9. The heating element according to claim 2, wherein the at least one substrate is impregnated with said perfluorinated polymer.

10. The heating element according to claim 2, wherein the at least one electrical resistance layer comprises a metal sheet.

11. The heating element according to claim 3, wherein the at least one electrical resistance layer comprises a metal sheet.

12. The heating element according to claim 4, wherein the at least one electrical resistance layer comprises a metal sheet.

13. A process for manufacturing a heating element comprising:

depositing a first perfluorinated polymer-based film on a first substrate;

providing a conductive layer on said first perfluorinated polymer-based film; and shaping said conductive layer by etching said conducting layer.

14. The process according to claim 13, wherein providing said conductive layer comprises applying pressure between a metal sheet and said first perfluorinated polymer-based film.

15. The process according to claim 14, further comprising heating said first perfluorinated polymer-based film before providing said conductive layer.

16. The process according to claim 13, wherein providing said conductive layer comprises dispersing electrically conductive particles in said first perfluorinated polymer-based film.

17. The process according to claim 13, wherein providing said conductive layer comprises depositing an electrically conductive composition.

18. The process according to claim 17, wherein providing said conductive layer comprises screen printing said conductive layer.

19. The process according to one of claims 13–18, further comprising:

depositing a second perfluorinated polymer-based film on a second substrate; and assembling said second perfluorinated polymer-based film with said conductive layer by applying pressure between said second perfluorinated polymer-based film and said conductive layer.

20. An household appliance comprising:

a heating element, wherein said heating element comprises:

at least one substrate;

at least one electrical resistance layer; and a binder configured to bind said at least one electrical resistance layer to said at least one substrate, wherein said binder has a melting temperature greater than an operating temperature of the heating element and comprises a perfluorinated polymer.

21. The household appliance according to claim 20, further comprising a plurality of said heating elements.

* * * * *